US008927915B1

(12) United States Patent
Clark

(10) Patent No.: US 8,927,915 B1
(45) Date of Patent: Jan. 6, 2015

(54) DETECTION OF ROCKET BODY THROUGH AN ACTIVE FIRING PLUME

(75) Inventor: Frank O. Clark, Andover, MA (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 285 days.

(21) Appl. No.: 13/531,286

(22) Filed: Jun. 22, 2012

(51) Int. Cl.

| | |
|---|---|
| ***F41G 7/22*** | (2006.01) |
| ***F42B 15/01*** | (2006.01) |
| *F41G 7/00* | (2006.01) |
| *F42B 15/00* | (2006.01) |

(52) U.S. Cl.

CPC ..... *F41G 7/22* (2013.01)

USPC ..... 244/3.16; 382/100; 382/103; 89/1.11; 244/3.1; 244/3.15; 244/3.19; 250/336.1; 250/338.1; 250/339.01; 250/339.14; 250/339.15; 250/200; 250/201.1; 250/203.1; 250/203.3; 250/203.6

(58) Field of Classification Search

CPC ..... F41H 11/00; G01S 3/78; G01S 3/781; G01S 17/02; G01S 17/06; G01S 17/66; F41G 7/20; F41G 7/22; F41G 7/2246; F41G 7/2253; F41G 7/226

USPC ..... 89/1.11, 1.1; 244/3.1, 3.15–3.19; 382/100, 103, 162, 163, 165, 173; 348/169–172; 250/336.1, 338.1, 250/339.01, 339.14, 339.15, 372, 200, 250/201.1, 203.1, 203.3, 203.6; 356/3, 356/4.01, 4.07, 5.01, 5.03, 5.04, 300, 326, 356/364, 402, 416; 342/61, 62, 89, 90

See application file for complete search history.

(56) References Cited

U.S. PATENT DOCUMENTS

| | | | | |
|---|---|---|---|---|
| 4,383,663 | A * | 5/1983 | Nichols | 244/3.16 |
| 5,001,348 | A * | 3/1991 | Dirscherl et al. | 250/372 |
| 5,109,435 | A * | 4/1992 | Lo et al. | 382/103 |
| 5,198,657 | A * | 3/1993 | Trost et al. | 356/5.04 |
| 5,220,164 | A * | 6/1993 | Lieber et al. | 356/5.04 |
| 5,300,780 | A * | 4/1994 | Denney et al. | 250/203.6 |
| 5,428,221 | A * | 6/1995 | Bushman | 244/3.16 |
| 5,430,448 | A * | 7/1995 | Bushman | 250/372 |
| 5,479,255 | A * | 12/1995 | Denny et al. | 244/3.16 |
| 5,504,486 | A * | 4/1996 | Bushman | 342/90 |
| 5,625,452 | A * | 4/1997 | Hasson | 356/326 |
| 5,657,251 | A * | 8/1997 | Fiala | 382/103 |
| 5,677,761 | A * | 10/1997 | Hasson | 356/4.07 |
| 5,793,889 | A * | 8/1998 | Bushman | 244/3.16 |
| 5,999,652 | A * | 12/1999 | Bushman | 382/103 |
| 6,031,935 | A * | 2/2000 | Kimmel | 382/173 |
| 6,222,618 | B1 * | 4/2001 | Hasson | 250/339.15 |
| 6,655,124 | B2 | 12/2003 | Vickery et al. | |
| 6,677,571 | B1 | 1/2004 | Clark et al. | |
| 6,684,622 | B2 | 2/2004 | Vickery et al. | |
| 6,958,813 | B1 * | 10/2005 | Ahmadjian et al. | 356/416 |
| 7,240,878 | B2 | 7/2007 | Towne | |
| 7,400,289 | B1 * | 7/2008 | Wolf | 244/3.1 |
| 7,420,675 | B2 * | 9/2008 | Giakos | 356/364 |
| 7,473,876 | B1 | 1/2009 | Pedersen et al. | |
| 7,916,947 | B2 * | 3/2011 | Conger et al. | 382/103 |
| 7,991,192 | B2 * | 8/2011 | Lee et al. | 382/103 |
| 8,269,171 | B2 * | 9/2012 | Gorin | 250/338.5 |

* cited by examiner

*Primary Examiner* — Bernarr Gregory
(74) *Attorney, Agent, or Firm* — James M. Skorich

(57) ABSTRACT

Apparatus and a method for intercepting a rocket body during boost phase. A sensor is arranged to detect thermal emission in a range that is characteristic of a firing rocket body. The image detected by the sensor is applied to an analog-to-digital converter for digitization and application to a computer that includes a routine for separating the modulated photon energy of the detected image from the substantially unmodulated photon energy that characterizes rocket body emissions. The unmodulated photon energy, signature of the rocket body, may be utilized by a fire control system for tracking, targeting and aiming munitions at the firing rocket body.

8 Claims, 2 Drawing Sheets

DETECTION OF ROCKET BODY THROUGH AN ACTIVE FIRING PLUME

GOVERNMENT INTEREST

The conditions under which this invention was made are such as to entitle the Government of the United States under paragraph 1(a) of Executive Order 10096, as represented by the Secretary of the Air Force, to the entire right, title and interest therein, including foreign rights.

BACKGROUND

1. Field of the Invention

The present invention relates to the interception of a rocket body during boost phase. More particularly, this invention pertains to a method and apparatus for boost phase intercept despite the presence of a much brighter active firing plume.

2. Description of the Prior Art

Missile intercept during boost phase is highly advantageous. Should a missile be destroyed early enough in the boost phase, the payload may fall back into the territory of the launching entity or otherwise fall short of its intended target. Further, present day missiles are not capable of releasing decoys or multiple warheads ("MIRV"), whose presence can greatly complicate tracking and analysis, until completion of the boost phase. Accordingly, boost phase intercept is highly desirable.

Unfortunately, during boost phase, the rocket engine is firing and producing a plume whose thermal emission is as much as two orders of magnitude greater than the thermal emission signature produced by the rocket body. As a result, details of the rocket body are effectively obscured during the boost phase.

The analysis of an image detected by a passive sensor, in the presence of environmental clutter, to ascertain whether or not it represents the plume characteristic of a firing rocket body in boost phase is discussed in U.S. Pat. No. 6,677,571 of Clark et al. covering "Rocket Launch Detection Process". While it is essential to characterize an image as a firing rocket plume or otherwise, significantly more detailed information is required for targeting and interception of the associated rocket body.

SUMMARY AND OBJECTS OF THE INVENTION

It is therefore an object of the present invention to provide a method and apparatus for detecting and targeting a rocket body for intercept during boost phase.

It is another object of the invention to accomplish the foregoing object by means of a method that requires only existing sensors functioning within presently implemented frame rates.

The present invention addresses shortcomings of the prior art by providing, in a first aspect, a method for defining the image of a firing rocket body during boost phase. The method is begun by selecting a detection wavelength in accordance with a boost phase temperature of the rocket body. A preselected region is then scanned at the detection wavelength to receive a detected image characteristic of the rocket body during boost phase. A component of the detected image corresponding to a plume of the firing rocket body during boost phase is then removed whereby substantially only the image of the rocket body remains.

In another aspect, the invention provides a method for intercepting a firing rocket body during boost phase. The method is begun by selecting a detection wavelength in accordance with a boost phase temperature of the rocket body. A preselected region is scanned at the detection wavelength at a predetermined rate to receive a detected image. A component of the detected image corresponding to a plume of the firing rocket body is analytically removed during boost phase whereby substantially only data representing the image of the rocket body remains. The data is then encoded to generate a signal for real time tracking of the rocket body by a fire control system. Such signal is then applied to the fire control system to enable interception of the rocket body.

In a third aspect, the invention provides apparatus for intercepting a firing rocket body during boost phase. Such apparatus includes a sensor for detecting radiation of predetermined wavelength. An analog-to-digital converter transforms a detected image to a digital data representation. A computer is programmed to remove data describing the detected image that corresponds to modulated photon content from data that corresponds to substantially unmodulated photon content over a predetermined frequency range that includes the predetermined wavelength.

A signal conditioner is provided for receiving the data corresponding to substantially unmodulated photon content and for providing a tracking signal in response. A fire control system receives the signal and engages the rocket body in response.

The preceding and other features of the invention are described in the written description that follows. Such description is accompanied by a set of drawing figures. Numerals of the drawing figures, corresponding to those of the written description, point to the features of the invention. Like numerals refer to like features throughout both the written description and the drawings.

DETAILED DESCRIPTION OF THE PREFERRED EMBODIMENT

Figure 1:
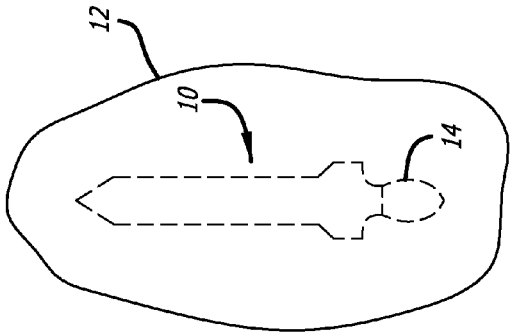
FIG. 1 illustrates the signature of a rocket body during boost phase as imaged by a thermal energy sensor.

Turning now to the drawings, FIG. 1 illustrates the signature of a rocket body 10 during boost phase as detected by a thermal energy sensor. Such phase is critical to successful intercept as it currently occurs prior to the launch of multiple warheads and decoys that could significantly complicate tracking and interception.

The targeting and aiming for interception of the firing rocket body 10 is complicated by the existence of an associated plume 12 during boost phase detection by a thermal sensor. Such plume 12, which may partially or completely envelope the rocket body 10, results from the interaction of the heated rocket engine exhaust 14 with the turbulence created by the supersonic speed of the plume itself as it travels through the atmosphere. As can be seen, the rocket body and exhaust 14 are illustrated by broken lines whereas the outline of the plume 12 is a solid line. This represents the fact that the thermal image of a rocket body is much fainter than, and effectively obscured by, that of the associated plume 12 as detected by a thermal energy sensor. The rocket body 10 is relatively cool (about 300 K) compared to the engine exhaust-generated plume 12 (about 2000 K). The outline of the hot exhaust 14 emitted by the firing rocket body is illustrated by broken lines as its more intense signature, a useful targeting point, is obscured by the surrounding plume it generates. A plume is virtually always significantly larger, as well as brighter, than a rocket body. At typical intercept altitudes, the much-brighter plume becomes truly huge and engulfs the entire rocket body. As an interceptor routinely incorporates a thermal infrared detector as an element of a fire control system as this is the only way to detect a rocket body, the brightness and size of the plume at detection wavelengths significantly degrades the possibility of successful boost phase intercept. An additional complication presented by the interaction of heated exhaust gases with air turbulence is the phenomenon known as "self-blinding" whereby the quality and usefulness of the image of the rocket body detected by the infrared sensor of the interceptor is subject to significant obscuration by a plume generated by the traveling interceptor vehicle itself. Both of such blinding pheonmena will be seen to be addressed by the operation of the method and apparatus of the invention discussed below.

Figure 2A:
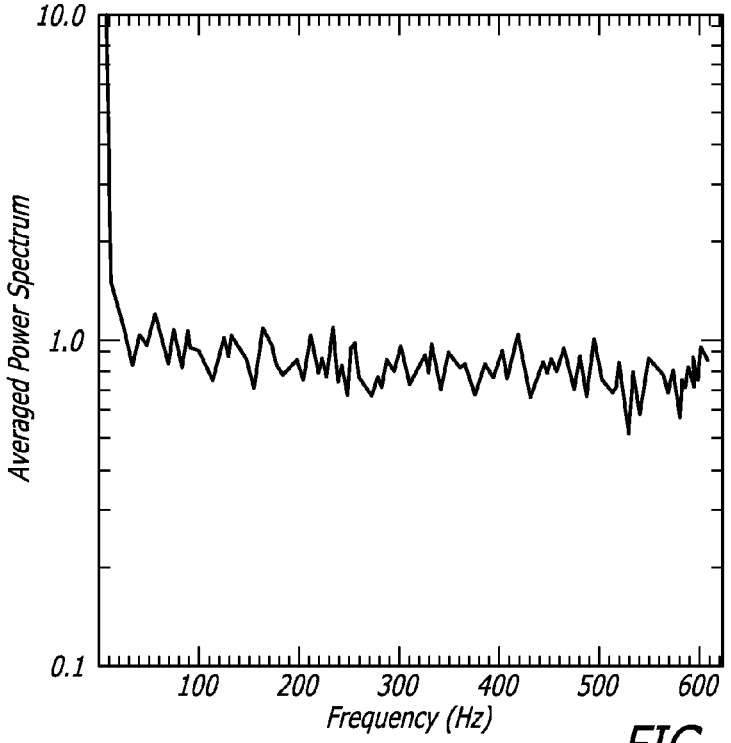
FIGS. 2(*a*) and 2(*b*) are graphical representations in PSD (power spectral density) space of the power spectra that characterize the radiometric emissions of a rocket body and an associated plume during boost phase, respectively.
Figure 2B:
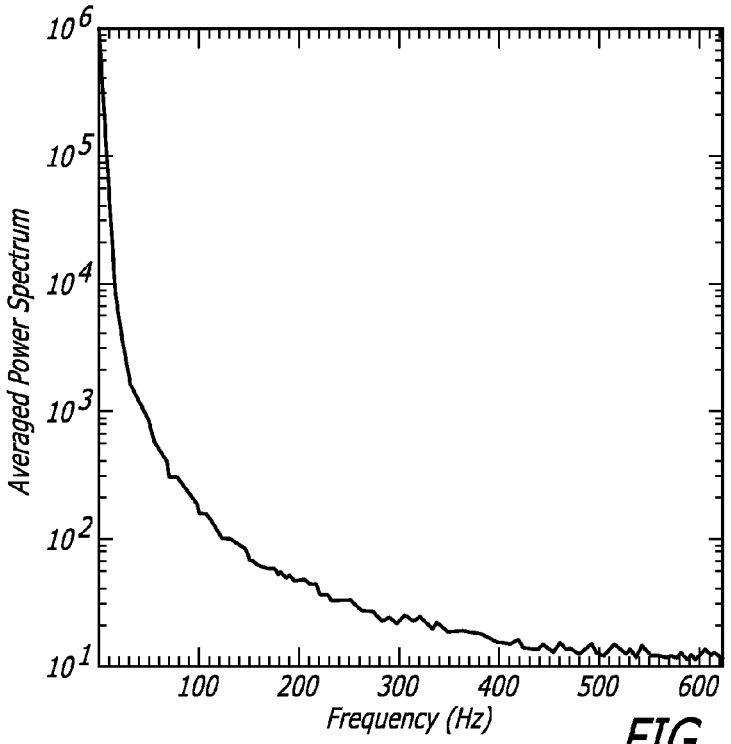

FIGS. 2(*a*) and 2(*b*) are graphical representations in PSD (power spectral density) space of the power spectra that characterize the radiometric emissions of a rocket body and an associated plume during boost phase, respectively. The spectra correspond to emissions detected in the region of thermal energy (around 10 μm. Rocket body emissions typically lie in the range of 5 to 12 μm.) The data of the two figures is based upon static testing of a firing rocket body. The power spectrum representation of the detected thermal emissions is generated through rapid sampling (rates of 100's of kiloHertz) and examination of the Fourier Transform of the emitted radiant energy in the power spectral density domain (power per Hertz as a function of frequency).

Comparing the two graphs, it is seen that the two spectra differ significantly in character. That is, while the detected thermal emission from the rocket body is nearly all at 0 Hz in the region of the detection wavelength (FIG. 2(*a*)), that reflecting the significantly more intense energy detected from the plume generated by the firing rocket body (FIG. 2(*b*)), measured during static testing, displays a continuum that decreases as frequency increases (roughly 1/f, where f is frequency). This characteristic of the continuum of the energy of a plume in PSD space is disclosed in the Clark et al. patent, infra. The large modulated fraction of emissive photons reflected in the frequency dependence of detected plume emission reflects the variation of plume intensity due to the presence of turbulence. In contrast, the relatively stable graph of FIG. 2(*a*) reflects the fact that the rocket body emits primarily unmodulated (mostly zero frequency) thermal photons.

The invention relies upon the differing characters of the radiometric emissions of a rocket body and its associated plume during the critical boost phase to effectively "remove" the plume and reveal the underlying rocket body to the interception mechanisms of a fire control system, airborne or otherwise. A number of recognized mathematical routines are currently available and well known to those skilled in the art for removing or filtering out turbulence-modulated photons, thus removing the plume from a detected image that is a combination of rocket body and plume emissions. Such methods or routines include, but are not limited to, Fourier analysis, differencing and principal component analysis. Each such routine is capable of separating out those detected photons in accordance with their method of modulation. An ensemble average is measured with those photons associated with modulation by plume turbulence being removed by the selected routine.

Figure 3:
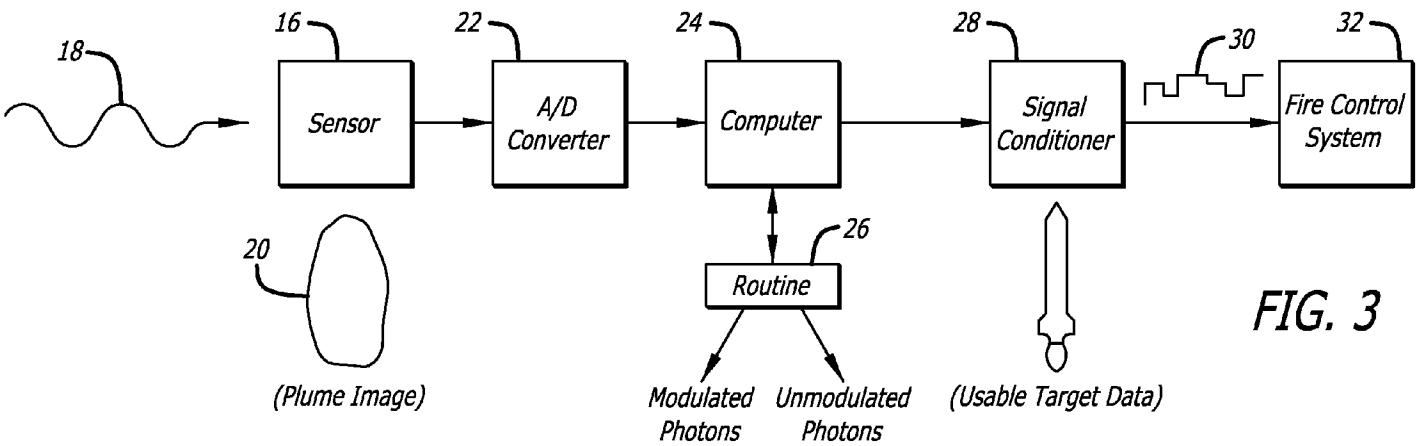
FIG. 3 is a schematic block diagram of a boost phase intercept system in accordance with the invention.

FIG. 3 is a schematic block diagram of a boost phase intercept system in accordance with the invention. A passive sensor 16 is adapted to receive and detect energy 18 of wavelength suitable for detecting the presence of a rocket body. The sensor 16 may be any of a number of devices suitable for detecting infrared or near-infrared radiation that relies upon the black body or gray body radiation from a target to detect signals of thermal origin.

As mentioned earlier, the image detected by the sensor 16 is not sufficiently specific with respect to the information required for tracking and targeting a firing rocket body due to the dominating and obscuring presence of a relatively-intense image of an associated plume 20.

The image detected by the sensor 16 is applied to an analog-to-digital converter 22 where it is digitized prior to being input to a computer 24 that is programmed to include a routine 26 for mathematically removing the modulated photons from the image detected by the sensor 16. Appropriate routines for mathematically removing the modulated photons include, as mentioned above, Fourier analysis, differencing and principal component analysis. In effect, the substantially unmodulated ("d.c.") photons are mathematically extracted from the digitized image that is input to the computer 24, leaving data describing the shape and position of the rocket body itself absent the shrouding effect of the more-intense detected image of the associated plume.

Blackbody estimates suggest that the underlying rocket body will be about eight (8) percent as bright as the plume at thermal wavelengths (in the neighborhood of 10 μm), while the plume fractional modulation is on the order of a few percent. Therefore, removal of the modulated fraction of plume emission easily reveals the underlying rocket body at wavelengths sensitive to the rocket body emission (typically 5 to 12 μm).

The data describing the shape and position of the rocket body are applied to a signal conditioner 28 that converts such data into an appropriately-formatted signal 30 for use by an interceptor fire control system 32. Such a system 32 may employ this information for aim point analysis to drive the divert and attitude control system (DAC) of an interceptor. As an alternative, such information may be employed to determine the aim point for shipboard, ground based, or other fire control (e.g. for a kinetic weapon, laser or other light-speed interdiction system).

Static testing of the concepts disclosed herein has shown that the plume associated with a firing rocket body may be removed through removal of the modulated photons. Such testing, with radiation detection performed by a sensor operating in the infrared at 8 to 9.5 μm, was performed at a modest frame rate of 57 Hz per second, or about double that for standard video. Upon application of a Fourier transform to the detected image, the underlying thermal emission from the missile engine itself as well as the warm nozzle and surrounding vanes (a complete rocket body was not employed for the static test, only an engine) were clearly revealed.

Thus it is seen that the present invention provides a method and apparatus for passive detection of an underlying rocket body in the presence of a much brighter detected plume. By employing the teachings of the invention, one may reduce the effects of plume emission by several orders of magnitude, rendering possible imaging of the underlying rocket body for targeting purposes. The invention operates passively and does not require excessive frame rates so that, with appropriate processing, plumes appear distinctly different from the thermal emissions of rocket bodies.

While this invention has been described with reference to its presently preferred embodiment, it is not limited thereto. Rather, the invention is limited only insofar as it is defined by the following set of patent claims and includes within its scope all equivalents thereof.

KEY TO ELEMENT REFERENCE NUMBERS

10 Rocket body
12 Plume
14 Exhaust
16 Sensor
18 Energy
20 Plume image
22 Analog-to-digital converter
24 Computer
26 Routine
28 Signal conditioner
30 Formatted signal
32 Fire control system

What is claimed is:

1. A method for defining the image of a firing rocket body during boost phase comprising the steps of:

a) selecting a detection wavelength in accordance with a boost phase temperature of said rocket body; then b) scanning a preselected region at said detection wavelength to receive a detected image characteristic of aid rocket body during boost phase; and then c) removing a component of said detected image corresponding to a plume of said firing rocket body during boost phase whereby substantially only the image of said rocket body remains.

2. A method as defined in claim 1 further characterized in that said step of removing a component of said detected image corresponding to a plume of said rocket body during boost phase is performed by applying a mathematical routine to data describing said detected image.

3. A method as defined in claim 1 wherein said step of removing said component of said detected image corresponding to said plume further includes the steps of:

a) isolating modulated photons comprising said detected image; and b) removing said modulated photons from said detected image.

4. A method as defined in claim 3 wherein said steps of isolating modulated photons comprising said detected image and removing said modulated photons from said detected image are performed by applying Fourier analysis to data describing said detected image.

5. A method as defined in claim 3 wherein said steps of isolating modulated photons comprising said detected image and removing said modulated photons from said detected image are performed by applying a differencing routine to data describing said detected image.

6. A method as defined in claim 3 wherein said steps of isolating modulated photons comprising said detected image and removing said modulated photons from said detected image are performed by applying principal component analysis to data describing said detected image.

7. A method for intercepting a firing rocket body during boost phase comprising the steps of:

a) selecting a detection wavelength in accordance with a boost phase temperature of said rocket body; then b) scanning a preselected region at said detection wavelength at a predetermined rate to receive a detected image; then c) analytically removing a component of said detected image corresponding to a plume of said firing rocket body during boost phase whereby substantially only data representing the image of said rocket body remains; then d) encoding said data to generate a signal for real time tracking of said rocket body by a fire control system; and then e) applying said signal to said fire control system to enable interception of said rocket body.

8. Apparatus for intercepting a firing rocket body during boost phase comprising, in combination:

a) a sensor for detecting radiation of predetermined wavelength;

b) an analog-to-digital converter for transforming a detected image to a digital data representation;

c) a computer programmed to remove data describing said detected image corresponding to modulated photon content horn data corresponding to substantially unmodulated photon content over a predetermined frequency range that includes said predetermined wavelength;

d) a signal conditioner for receiving said data corresponding to substantially unmodulated photon content and providing a tracking signal in response thereto; and e) a fire control system for receiving said signal and engaging said rocket body in response thereto.

* * * * *